US006428146B1

(12) United States Patent
Sharma et al.

(10) Patent No.: US 6,428,146 B1
(45) Date of Patent: Aug. 6, 2002

(54) FLUID PUMP, INK JET PRINT HEAD UTILIZING THE SAME, AND METHOD OF PUMPING FLUID

(75) Inventors: Ravi Sharma, Fairport; Kwok L. Yip, Webster, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/708,880

(22) Filed: Nov. 8, 2000

(51) Int. Cl.[7] ..... B41J 2/04
(52) U.S. Cl. ..... 347/54
(58) Field of Search ..... 347/54, 68, 69, 347/70, 71, 72, 50, 40; 399/261; 361/700; 310/328–330; 29/890.1

(56) References Cited

U.S. PATENT DOCUMENTS

| | | | |
|---|---|---|---|
| 2,896,507 | A | 7/1959 | Mast et al. |
| 3,716,359 | A | 2/1973 | Sheridon |
| 4,065,308 | A | 12/1977 | Bergen |
| 4,163,667 | A | 8/1979 | Wysocki |
| 4,646,106 | A | 2/1987 | Howkins |
| 5,495,280 | A | 2/1996 | Gehner et al. |
| 5,739,832 | A | 4/1998 | Heinzl et al. |
| 5,764,258 | A | 6/1998 | Hetzer et al. |
| 5,867,301 | A | 2/1999 | Engle |

FOREIGN PATENT DOCUMENTS

| | | |
|---|---|---|
| WO | WO 99/17083 | 4/1999 |

*Primary Examiner*—Raquel Gordon
(74) *Attorney, Agent, or Firm*—Milton S. Sales

(57) ABSTRACT

A fluid pump, such as a print head, includes an ink channel having a nozzle and at least one wall having a flexible portion. A deforming member made of a viscoelastic material is coupled to the flexible portion and a charge mechanism is coupled to the deforming member to apply a spatially varied charge pattern to the deforming member when activated. Activation of the charge mechanism causes deformation of the deforming member and the flexible portion to reduce the volume of the ink channel and eject a droplet of ink out of the ink channel. The charge mechanism can include a photoelectric material and a radiation source or an electrode coupled to a source of electric power.

19 Claims, 2 Drawing Sheets

FLUID PUMP, INK JET PRINT HEAD UTILIZING THE SAME, AND METHOD OF PUMPING FLUID

FIELD OF THE INVENTION

The present invention relates generally to fluid pumps, and more particularly to deforming a viscoelastic material to propel fluid through the pump, an ink jet print head utilizing the pump, and a method of pumping fluid.

BACKGROUND OF THE INVENTION

Various types of pumps are known for use in "drop on demand" (DOD) print heads, such as ink jet print heads. For example, in a thermal type bubble jet printer, ink in a channel is heated to a boil to create a bubble until the pressure ejects a droplet of the ink out of a nozzle. The bubble then collapses as the heating element cools, and the resulting vacuum draws fluid from a reservoir to replace the fluid that was ejected from the channel. Such thermal types of pumps require that the ink be resistant to heat, i.e. capable of being boiled without significant breakdown. Also, the need for a cooling period between ejecting successive droplets from a nozzle places speed limitations on thermal pumps.

Piezoelectric pumps, such as that disclosed in U.S. Pat. No. 5,224,843, have a piezoelectric crystal in the fluid channel that flexes when an electric current flows through it to force a drop of fluid out of a nozzle. Piezoelectric technology provides more control over the fluid movement as compared to thermal technology. Also, because the fluid to be pumped is not heated significantly, the fluid can be selected based on its relevant properties rather than its ability to withstand high temperatures. However, piezoelectric microscale pumps are complex and thus expensive to manufacture. For example, piezoelectric materials generally are not suitable for interface with fluids and thus inner walls of the ink chamber must be coated with metal or the like. Further, piezoelectric devices generally are not compatible with known CMOS processes. Also, ink chambers incorporating piezoelectric materials are difficult to form, usually requiring that the piezoelectric material be sawed and glued. Finally, Piezoelectric pumps require a relatively large voltage for adequate wall deflection for most print head applications, e.g. 30–35 volts for a 2 nm deflection.

It is also known to place a modulated electric field across an elastomer to deform the elastomer in conformance with an image and to read out the image from the deformed elastomer. This device is known as the "Ruticon" device and is disclosed, for example, in U.S. Pat. No. 3,716,359.

SUMMARY OF THE INVENTION

An object of the invention is to decrease the voltage required for pumping ink in DOD print heads.

Another object of the invention is to simplify the construction of DOD print heads.

Another object of the invention is to utilize semiconductor fabrication techniques to manufacture a fluid pump.

Another object of the invention is to utilize standard CMOS processes to manufacture a fluid pump.

Another object of the invention is to reduce costs associated with manufacturing DOD print heads.

The invention achieves these and other objects through a first aspect of the invention which is a print head comprising an ink channel having a nozzle and at least one wall having a flexible portion, a deforming member coupled to the flexible portion, and a charging mechanism coupled to the deforming member and configured to apply a spatially varied charge pattern to the deforming member when the charge mechanism is activated. Activation of the charge mechanism causes deformation of the deforming member and the flexible member to thereby reduce the volume of the ink channel and eject a droplet of ink out of the ink channel.

A second aspect of the invention is a fluid pump comprising a fluid channel having a nozzle and at least one wall having a flexible portion, a deforming member coupled to the flexible portion, and a charge mechanism coupled to the deforming member and configured to apply a spatially varied charge pattern to the deforming member when the charge mechanism is activated. Activation of the charge mechanism causes deformation of the deforming member and the flexible member to thereby reduce the volume of the fluid channel and eject fluid out of the fluid channel.

A third aspect of the invention is a method of pumping a fluid comprising the steps of coupling a deforming member to a flexible portion of a fluid channel, and reducing the volume of the fluid channel by applying a spatially varied charge pattern to the deforming member to cause deformation of the deforming member and the flexible member to eject fluid out of the fluid channel.

BRIEF DESCRIPTION OF THE DRAWINGS

Other features and advantages of the present invention will become apparent from the following description of the preferred embodiments of the invention, and the accompanying drawings, wherein.

DETAILED DESCRIPTION OF THE INVENTION

Figure 1:
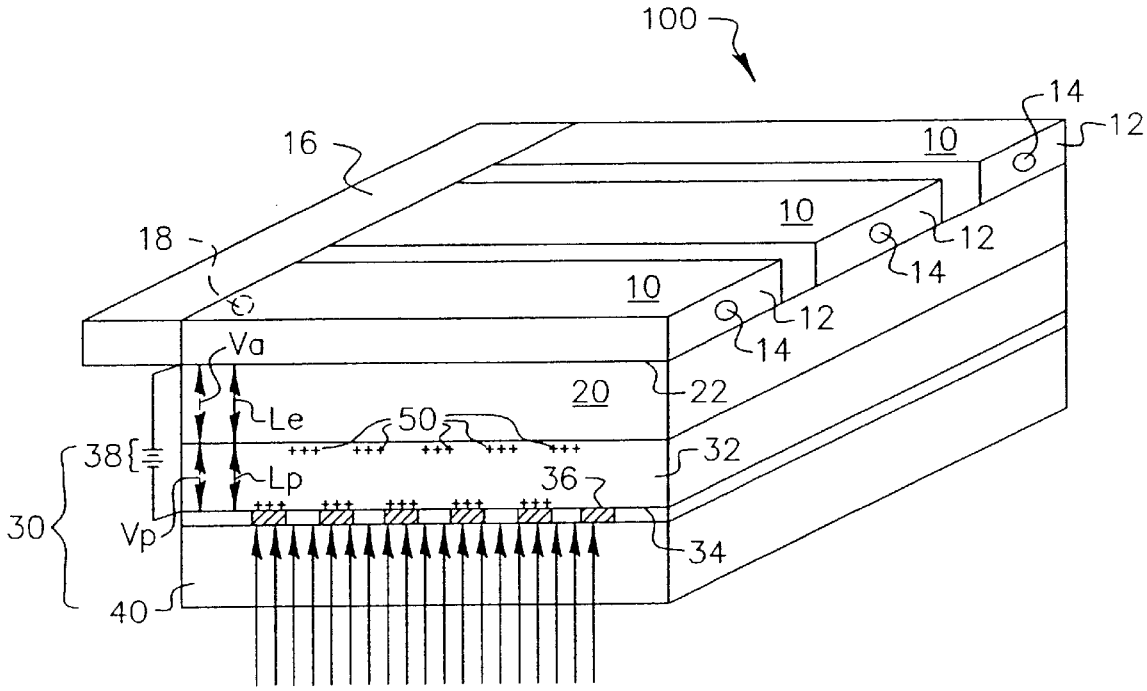
FIG. 1 is a perspective view of a first preferred embodiment of the invention.

FIG. 1 illustrates print head 100 in accordance with a first preferred embodiment of the invention which can be formed using known semiconductor fabrication techniques. However, the invention can be formed of various materials using various fabrication techniques. Print head 100 is suitable for use in a DOD printer or the like and includes a plurality of ink channels 10 each having nozzle plate 12 and orifice 14 formed in nozzle plate 12. Ink droplets are ejected through orifice 14 in the manner described in detail below to effect printing on a print medium (not illustrated). Ink is supplied to ink channels 10 from ink reservoir 16 through ports 18 (only one of which is illustrated by a dotted line).

Figure 2:
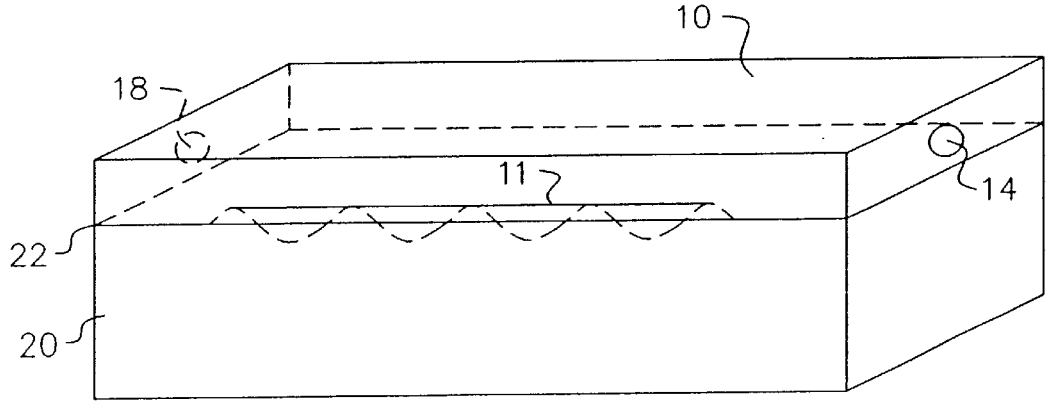
FIG. 2 is a detailed perspective view of a portion of the embodiment of FIG. 1.

One wall of ink channel 10, the lower wall in the preferred embodiment, includes flexible portion 11 (see FIG. 2). A deforming member is coupled to the flexible portion 11. In the preferred embodiment, the deforming member comprises elastomer layer 20 having flexible metal layer 22 disposed thereon. Charge mechanism 30 is disposed below elastomer layer 20 and comprises photoconductor layer 32, transparent electrode 34, optical screen 36, and voltage source 38. Optical screen 36 can be formed using known techniques, such as photolithography patterning and etching, or the like, and can include 40 screening lines per millimeter.

The particular construction and resolution of optical screen 36 can be varied based on practical considerations such as the size of ink channel 10, the desired droplet size, and the required response time of print head 100. All of the layers described above are formed on transparent substrate 40.

In operation, voltage source 38 is activated to apply an electric field across photoconductor layer 32 and elastomer layer 20. To activate print head 10 for ejecting an ink droplet, photoconductor layer 32 is exposed to radiation energy, such as monochromatic laser light, through optical screen 36. Accordingly, an electrostatic image will be formed at the interface between photoconductor layer 32 and elastomer layer 20 by the photo-induced discharge effect. More specifically, light energy absorbed by photoconductor layer 32 generates electron-hole pairs which migrate under the electric field applied by voltage source 38 to form an electrostatic image at the interface between photoconductor layer 32 and elastomer layer 20, as indicated by reference numeral 50.

The electrostatic image is transformed into a "deformation image", by the photo-induced discharge effect, at the surface of elastomer layer 20 and thus metal layer 22. Specifically, electrostatic forces acting on elastomer layer 20 cause elastomer layer 20 and metal layer 22 (i.e. the deforming member) to deform in an approximately sinusoidal pattern, as illustrated by the dotted line in FIG. 2. Such deformation of the deforming member causes inward displacement of flexible portion 11 in the wall of ink channel 10 thereby decreasing the volume of ink channel 10 and ejecting a droplet of ink out of the corresponding nozzle 14. Any residual deformation of the deforming member can be removed by removal of the applied electric field by deactivating voltage source 38, shorting the device, uniformly opposing the electric field, or in any other manner.

Portions of photoconductor layer 32 below the various ink channels 10 can be exposed to radiation energy in a controlled manner to eject ink droplets from the desired channels 10 in manner to form a desired image on print media. Such control can be effected in any manner. For example, a microprocessor based controller can control radiation sources, voltage source 38, a carriage carrying print head 100, and other elements to print images on print media based on an input signal from a computer or the like.

It has been determined that the amplitude of deformation of elastomer layer 20 is related to the length of exposure to radiation in the following manner:

$$D = \frac{\gamma}{4}\left[4(VV_{po} - V_{po}^2)\left(\frac{t}{tr}\right) + 2(3V_{po}^2 - VV_{po})\left(\frac{t}{tr}\right)^2 - 4V_{po}^2\left(\frac{t}{tr}\right)^3 + V_{po}^2\left(\frac{t}{tr}\right)^4\right]$$

where $\gamma$=a material constant of the elastomer

V=d.c. bias voltage applied uniformly to the device and maintained constant during the exposure of photoconductor to light.

$V_{po}$=voltage across the photoconductor at the beginning of exposure t=exposure time tr=the response time of the device, i.e., the time it takes for the voltage across the photoconductor layer to decrease to zero during the exposure.

See J. Appl. Physics 48, 2346 (1977), the disclosure of which is incorporated herein by reference.

It has been found that with an applied voltage of 70V and a 5 micron thick elastomer layer, a 3 picoliter droplet can be ejected within 20 microseconds. This assumes an ink channel that is about 3 mm×0.5 mm×0.1 mm (or comparable volume) and thus deflection of the flexible portion of the ink channel wall can be about 2 nanometers.

Additionally, the opposite wall, or any other wall, of ink channel 10 can include a flexible member and a corresponding deflecting member and charge mechanism can be coupled thereto. This reduces the required deflection by a factor of 2 and thus reduces the required exposure time and increases the printing speed.

Figure 3:
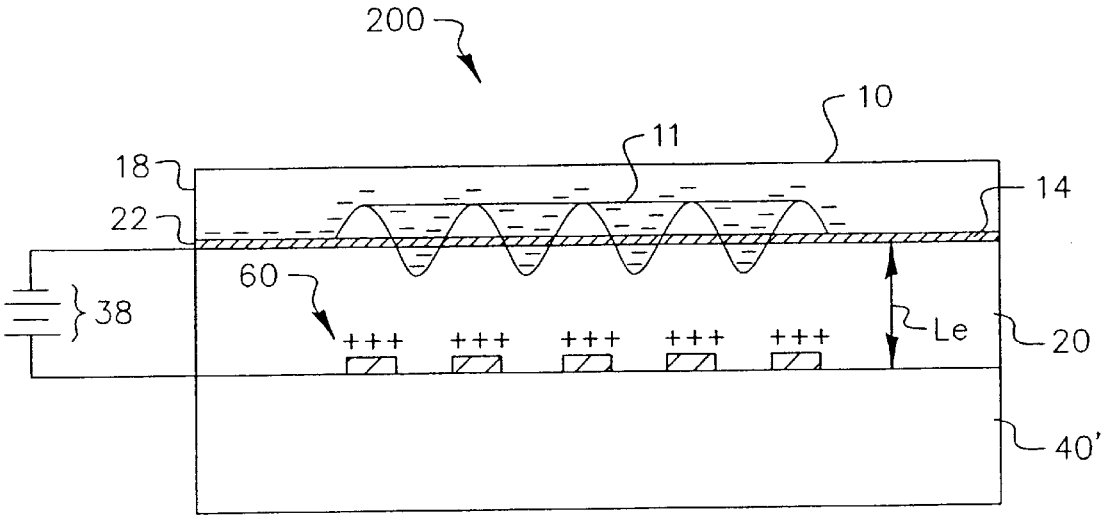
FIG. 3 is a side view of a second preferred embodiment of the invention.

FIG. 3 illustrates a second preferred embodiment of the invention. In the first preferred embodiment, performance can be limited by photoelectric properties, such as response time, of the photoconductor layer. The second preferred embodiment avoids this limitation by placing charge on the elastomer layer in a more direct manner. Specifically, print head 200 of the second preferred embodiment includes substrate 40, made from quartz for example, that need not be transparent to radiation. Electrode array 60 is formed on substrate 40' as described in greater detail below. Elastomer layer 20 is then formed on substrate 40' over electrode array 60 and flexible metal layer 22, serving as an electrode, is formed on elastomer layer 20. Ink channel 10, having flexible portion 11, is then disposed on elastomer layer 20 in a manner similar to the first preferred embodiment. Voltage source 38 is then coupled to electrode array 60 and flexible metal layer 22 to selectively place a voltage across electrode array 60 and flexible metal layer 22.

Figure 4:
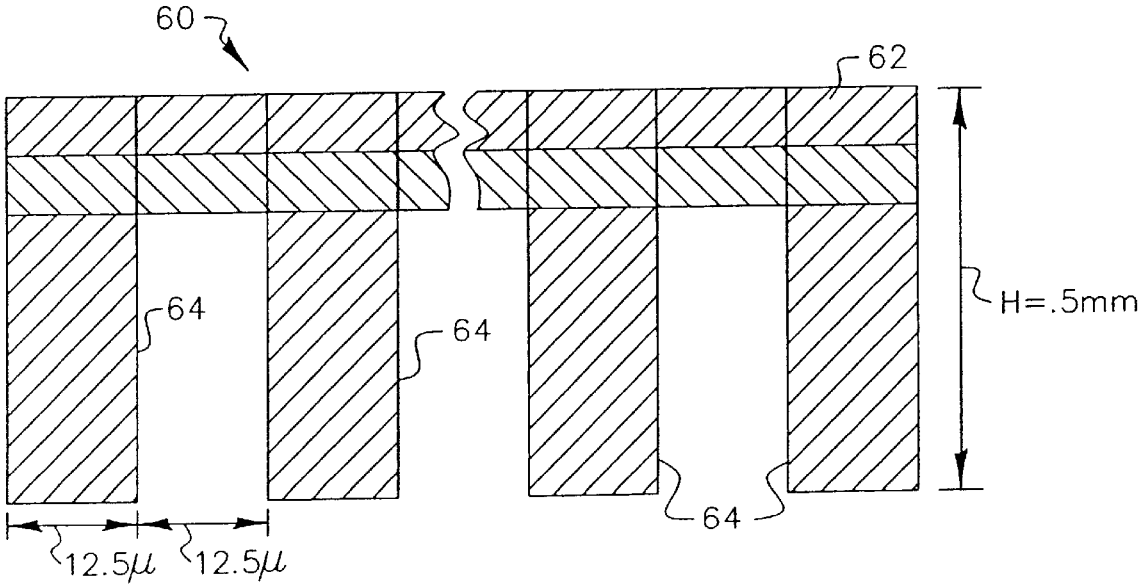
FIG. 4 is a top view of an electrode array of the embodiment of FIG. 3.

FIG. 4 illustrates a portion of electrode array 60. It can be seen that electrode array 60 comprises connecting portion 62 and a plurality of extending portions 64 extending from connecting portion 62 across a dimension of elastomer layer 20. As illustrated in FIG. 4, connecting portions 62 and extending portions 64 can be formed of chromium, 60 angstroms thick for example, through a sputtering process or any other method. Extending portions 64 can be formed at a density of 40 per mm. Further, extending portions 64 can be about 12.5 microns wide and about 0.5 mm long. Of course, the dimensions and pattern of electrode array 60 can be adjusted to provide the desired operating characteristics of print head 200, as will become apparent from the description below.

Connecting portion 62 serves to electrically couple extending portions 64 to one another. Accordingly, voltage source 38 causes a charge pattern to be formed on a lower portion of elastomer layer 20 in correspondence to extending portions 64. Electrostatic forces acting on elastomer layer 20, due to the charge pattern, cause elastomer layer 20 and metal layer 22 (i.e. the deforming member) to deform in an approximately sinusoidal pattern, as illustrated by the dotted line in FIG. 3. Such deformation of the deforming member causes inward displacement of flexible portion 11 in the wall of ink channel 10 thereby decreasing the volume of channel 10 and ejecting a droplet of ink out of the corresponding nozzle 14. Any residual deformation of the deforming member can be removed by removal of the applied electric field by deactivating voltage source 38, shorting the device, uniformly opposing the electric field, or in any other manner.

With an applied voltage of 15 volts and an 8 micron thick elastomer layer, a 3 picoliter droplet can be ejected within 75 microseconds. This assumes an ink channel that is about 3 mm×0.5 mm×0.1 mm (or comparable volume) and thus deflection of the flexible portion of the ink channel wall can be about 2 nm. This response is more that acceptable and is comparable to piezoelectric based devices.

The electric field can be applied in a controlled manner to eject ink droplets from the desired nozzles 14 in manner to form a desired image on print media. Such control can be effected in any manner. For example, a microprocessor based controller can control, voltage source 38, a carriage carrying print head 200, and other elements to print images on print media based on an input signal from a computer or the like.

The invention can be used to pump ink in a DOD printer or any other printer. Alternatively, the invention can be used to pump any type of fluid. The invention can be constructed using standard CMOS compatible semiconductor fabrication techniques or any other techniques. The invention can be of any size and the components thereof can have various relative dimensions. Any processes can be used to form the various components.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

PARTS LIST

10 Ink Channel
11 Flexible Portion
12 Nozzle Plate
14 Orifice
16 Ink Reservoir
18 Port
20 Elastomer Layer
22 Flexible Metal Layer
30 Charging Mechanism
32 Photoconductor Layer
34 Transparent Electrode
36 Optical Screen
38 Voltage Source
40 Transparent Substrate
40' Substrate
50 Electrostatic Image
60 Electrode Array
62 Connecting Portion
64 Extending Portion
100, 200 Print Head

What is claimed is:

1. A print head comprising:

an ink channel:

defining an internal volume, having a nozzle through which ink droplets are emitted from the channel when the volume of the channel is reduced, and being defined by at least one wall having a flexible portion;

a deforming member coupled to said flexible portion; and a charge mechanism coupled to said deforming member and configured to apply a spatially varied charge pattern to said deforming member when said charge mechanism is activated;

wherein activation of said charge mechanism causes deformation of said deforming member and said flexible member to thereby reduce the volume of said ink channel and eject a droplet of ink out of said reservoir.

2. A print head as recited in claim 1, wherein said deforming member comprises a viscoelastic material.

3. A print head as recited in claim 2, wherein said deforming member comprises an elastomer material.

4. A print head as recited in claim 2, wherein said charge mechanism comprises a photoconductor coupled to said deforming member.

5. A print head as recited in claim 4, further comprising a transparent substrate supporting said photoconductor.

6. A print head as recited in claim 2, wherein said deforming member further comprises a flexible electrode formed on a surface of said viscoelastic material.

7. A print head as recited in claim 2, wherein said charge mechanism comprises an electrode coupled to said elastomer material.

8. A print head as recited in claim 7, wherein said electrode comprises an electrode array.

9. A fluid pump comprising:

a fluid channel:

define an internal volume, having a nozzle through which ink droplets are emitted from the channel when the volume of the channel is reduced, and being defined by at least one wall having flexible portion;

a deforming member coupled to said flexible portion; and a charge mechanism coupled to said deforming member and configured to apply a spatially varied charge pattern to said deforming member when said charge mechanism is activated;

wherein activation of said charge mechanism causes deformation of said deforming member and said flexible member to thereby reduce the volume of said fluid channel and eject fluid out of said fluid channel.

10. A fluid pump as recited in claim 9, wherein said deforming member comprises a viscoelastic material.

11. A fluid pump as recited in claim 10, wherein said deforming member comprises an elastomer material.

12. A fluid pump as recited in claim 10, wherein said charge mechanism comprises a photoconductor coupled to said deforming member.

13. A fluid pump as recited in claim 12, further comprising a transparent substrate supporting said photoconductor.

14. A fluid pump as recited in claim 10, wherein said deforming member further comprises a flexible electrode formed on a surface of said viscoelastic material.

15. A fluid pump as recited in claim 10, wherein said charge mechanism comprises an electrode coupled to said elastomer material.

16. A fluid pump as recited in claim 15, wherein said electrode comprises an electrode array.

17. A method of pumping a fluid comprising the steps of: coupling a deforming member to a flexible portion of a fluid channel; and reducing the volume of the fluid channel by applying a spatially varied charge pattern to the deforming member to cause deformation of the deforming member and the flexible member to eject fluid out of the fluid channel.

18. A method as recited in claim 17, wherein said step of reducing the volume of the fluid channel comprises applying a spatially varied charge pattern to the deforming member by causing radiation energy to impinge on a photoconductor coupled to the deforming member.

19. A method as recited in claim 17, wherein said step of reducing the volume of the fluid channel comprises applying a spatially varied charge pattern to the deforming member by causing radiation energy to impinge on a photoconductor coupled to the deforming member.

* * * * *